US006827083B2

(12) United States Patent
Kawashima et al.

(10) Patent No.: US 6,827,083 B2
(45) Date of Patent: Dec. 7, 2004

(54) SNORKEL

(75) Inventors: Haruo Kawashima, Tokyo (JP); Katsuyuki Hori, Tokyo (JP); Taro Fujima, Tokyo (JP)

(73) Assignee: Tabata Co., Ltd., Tokyo (JP)

( * ) Notice: Subject to any disclaimer, the term of this patent is extended or adjusted under 35 U.S.C. 154(b) by 0 days.

(21) Appl. No.: 10/685,603

(22) Filed: Oct. 16, 2003

(65) Prior Publication Data

US 2004/0079366 A1 Apr. 29, 2004

(30) Foreign Application Priority Data

Oct. 21, 2002 (JP) ..... 2002-306359

(51) Int. Cl.[7] ..... B63C 11/16

(52) U.S. Cl. ..... 128/201.11; 128/201.27; 128/206.29

(58) Field of Search ..... 128/201.11, 201.27, 128/201.28, 206.29

(56) References Cited

U.S. PATENT DOCUMENTS

| | | | | | |
|---|---|---|---|---|---|
| 2,317,236 | A | * | 4/1943 | Wilen et al. | 128/201.11 |
| 3,051,170 | A | * | 8/1962 | Benzel | 128/201.11 |
| 3,860,042 | A | * | 1/1975 | Green | 128/201.11 |
| 3,993,060 | A | * | 11/1976 | Mitchell | 128/201.11 |
| 4,071,024 | A | * | 1/1978 | Blanc | 128/201.11 |
| 4,195,922 | A | * | 4/1980 | Hajnal | 348/335 |
| 4,610,246 | A | * | 9/1986 | Delphia | 128/201.11 |
| 4,655,212 | A | * | 4/1987 | Delphia | 128/201.11 |
| 4,834,084 | A | | 5/1989 | Walsh | 128/201.11 |
| 4,860,739 | A | * | 8/1989 | Vandepol | 128/201.11 |
| 5,117,817 | A | * | 6/1992 | Lin | 128/201.11 |
| 5,143,059 | A | * | 9/1992 | Delphia | 128/201.11 |
| 5,199,422 | A | * | 4/1993 | Rasocha | 128/201.11 |
| 5,265,591 | A | * | 11/1993 | Ferguson | 128/201.11 |
| 5,267,556 | A | * | 12/1993 | Feng | 128/201.11 |
| 5,487,379 | A | * | 1/1996 | Koshiishi | 128/201.11 |
| 5,664,558 | A | * | 9/1997 | Wagner | 128/201.11 |
| 5,845,635 | A | * | 12/1998 | Hermansen et al. | 128/201.11 |
| 5,865,169 | A | * | 2/1999 | Lan et al. | 128/201.11 |
| 5,937,850 | A | * | 8/1999 | Kawashima et al. | 128/201.11 |
| 6,085,744 | A | * | 7/2000 | Hermansen et al. | 128/201.11 |
| 6,119,685 | A | * | 9/2000 | Kawashima et al. | 128/201.11 |
| 6,230,705 | B1 | * | 5/2001 | Kuo | 128/201.11 |
| 6,302,102 | B1 | * | 10/2001 | Giroux et al. | 128/201.11 |
| 6,516,797 | B2 | * | 2/2003 | Chen-Lieh | 128/201.11 |
| 6,679,253 | B1 | * | 1/2004 | Feng | 128/201.11 |

* cited by examiner

*Primary Examiner*—Aaron J. Lewis
(74) *Attorney, Agent, or Firm*—Clark & Brody

(57) ABSTRACT

Here is disclosed a snorkel comprising a mouthpiece section, an open end section, a tubular section being contiguous to the open end section and a connector section interposed between the mouthpiece section and the tubular section and provided with a check valve. First and second halves constituting the connector section are pressed against each other along respective peripheral edges of these halves and then covered with a belt-like section welded to the connector section from the outside.

5 Claims, 4 Drawing Sheets

SNORKEL

BACKGROUND OF THE INVENTION

This invention relates to a swimming snorkel. Conventional swimming snorkels comprise a mouthpiece section lying under the water during its use, an opened end section raised out of the water through which both an inspired air and an exhaled air can flow, a tubular section extending from the opened end section into the water and a connector section extending between the mouthpiece section and the tubular section. The mouthpiece section made of flexible elastic material is attached to the connector section and the mouthpiece is provided with a check valve enabling a part of air exhaled by a swimmer to be exhausted into the water. An example of such snorkel is disclosed in U.S. Pat. No. 4,834,084.

The connector section in the snorkel disclosed in the above-cited document is a molded component of rubber or plastics. The connector section is hollow and, in order to obtain this, a pair of halves constituting the connector section must be often injection molded followed by joining respective peripheral edges of these halves to each other using a technique of welding or adhesive bonding. However, phenomena such as deformation occurring in a cooling step immediately after the injection molding make it difficult to join the peripheral edges of these halves to each other properly in terms of water-tightness as well as joining strength.

SUMMARY OF THE INVENTION

It is an object of this invention to provide a snorkel improved so that a pair of halves constituting the connector section can be properly joined to each other in terms of joining strength as well as water-tightness.

According to this invention, there is provided a snorkel comprising a mouthpiece section lying under water and held in a swimmer's mouth, an open end section normally raised out of water, through which both an inspired air and an exhaled air freely flows, a tubular section extending upward in a vertical direction from the open end section into water, and a hollow connector section interposed between the mouthpiece section and the tubular section and provided with a check valve allowing the exhaled air to be exhausted into water.

The present invention is characterized in that the connector section is made of thermoplastic material and comprises first and second halves bulging outwardly of the snorkel, the first and second halves are pressed against each other along respective peripheral edges thereof opposed to each other and covered with a belt-like member made of thermoplastic material separately of the first and second halves, wherein the belt-like member extends along the peripheral edges and welded to the respective peripheral edges from an outside of the connector section.

This invention includes the following embodiments.

The first and second halves are respectively bowl-shaped and the connector section consisting of the first and second halves and the belt-like member is bulb-shaped.

At least a part of the belt-like member in its longitudinal direction presents a substantially C-shaped cross-section taken in a direction orthogonal to the peripheral edges of the first and second halves and has its inner surface welded to the peripheral edges.

The belt-like member has its color or color shade different from that of at least one of the first and second halves.

The check valve is mounted on a side wall of the connector section so as to be openable and closable in a transverse direction orthogonal to the vertical direction of the snorkel.

DETAILED DESCRIPTION OF THE PREFERRED EMBODIMENTS

Details of the snorkel according to this invention will be more fully understood from the description given hereunder with reference to the accompanying drawings.

Figure 1:
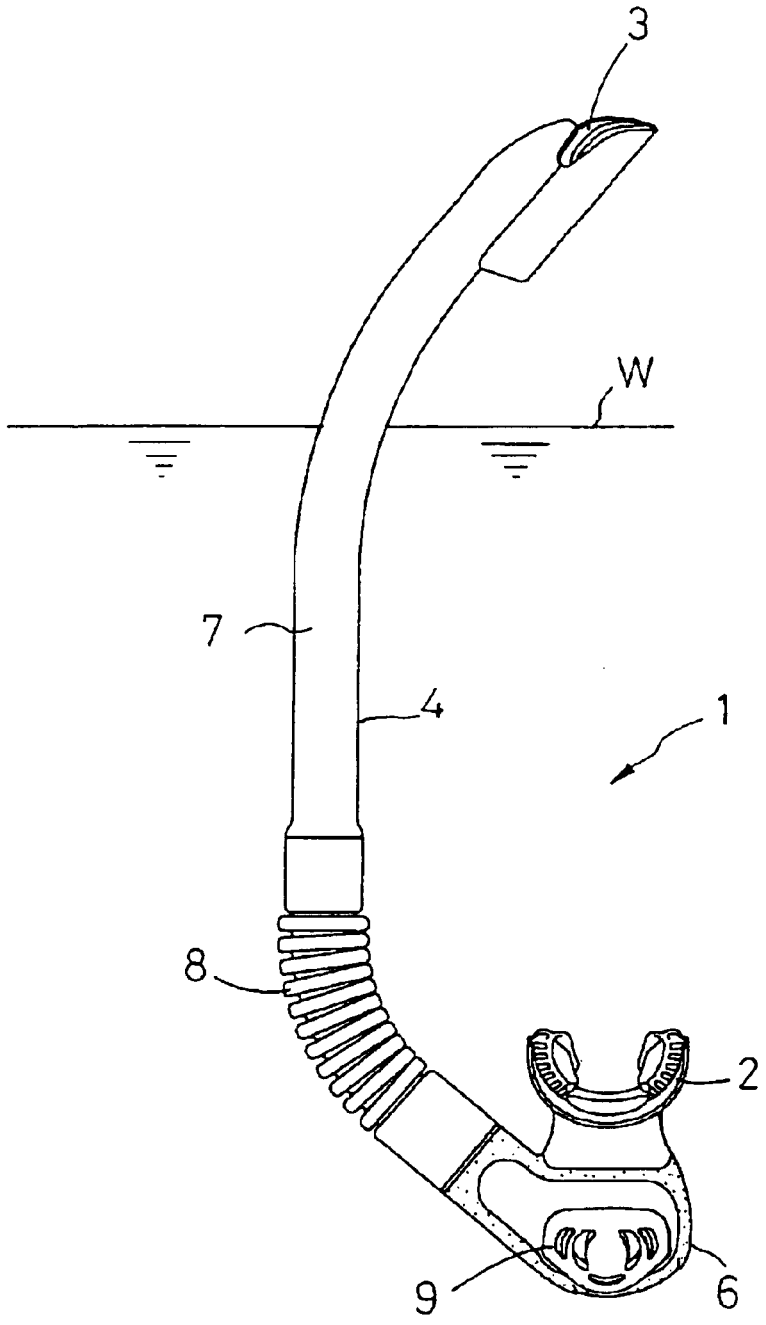
FIG. 1 is a front view of a snorkel.
Figure 2:
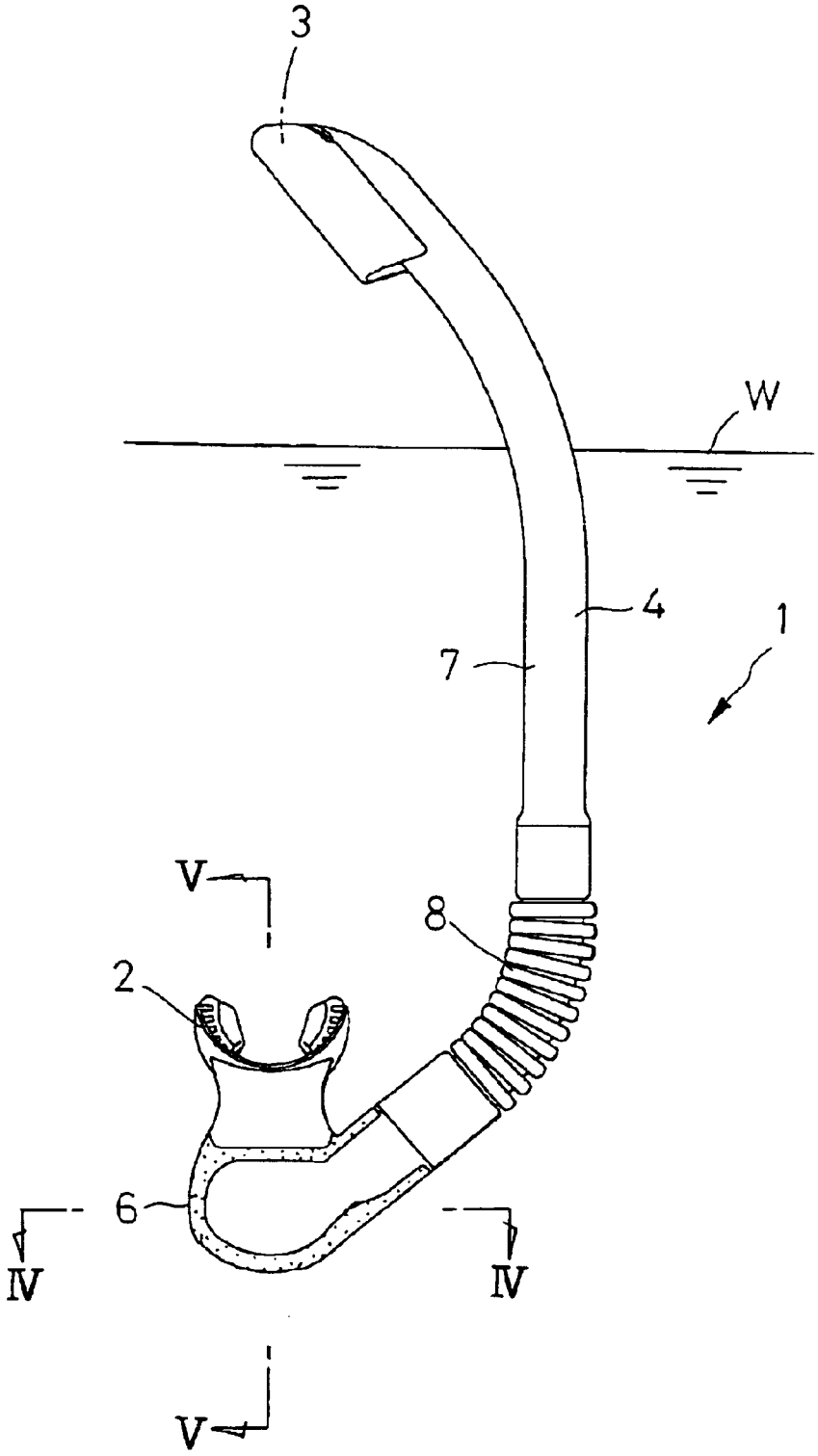
FIG. 2 is a rear view of the snorkel.

FIG. 1 is a front view of a snorkel 1 and FIG. 2 is a rear view of the snorkel 1. The snorkel 1 comprises a mouthpiece section 2 lying under the water W during use thereof and held in a swimmer's mouth, an open end section 3 raised out of the water W, a tubular section 4 extending from the open end section 3 into the water W and a connector section 6 interposed between the mouthpiece section 2 and the tubular section 4. The mouthpiece section 2 is made of flexible elastic material and adapted to be detachably connected to the tubular section 4. The upper open end section 3 is juxtaposed to a top of the tubular section 4 in fluid-communication with the tubular section 4 and defined by a short tubular piece made of rigid thermoplastic material. The tubular section 4 consists of an upper subsection 7 made of rigid thermoplastic material and a lower subsection 8 made of flexible elastic material in form of bellows. The lower subsection 8 is detachably connected to the connector section 6. As will be seen in the front view of FIG. 1, the connector section 6 is provided on one side thereof with a cover member 9 made of rigid thermoplastic material and provided inside the cover member 9 with a check valve 11 (See FIG. 3).

Figure 3:
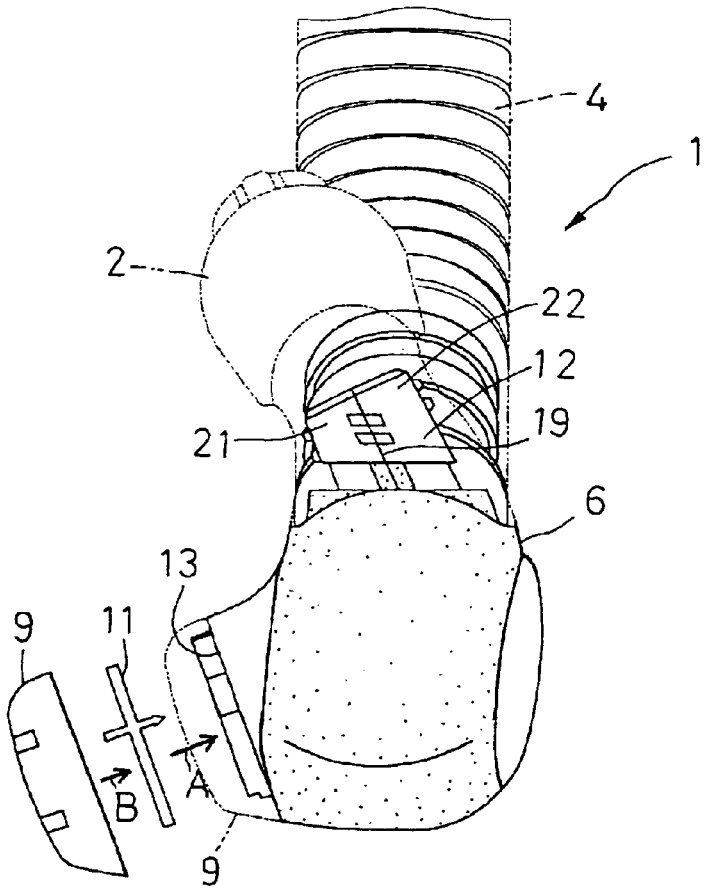
FIG. 3 is a side view of the snorkel.

FIG. 3 is a partial side view of the snorkel 1, in which the connector section 6 is indicated by solid lines while the mouthpiece section 2 and the tubular section 4 are indicated by imaginary lines. In FIG. 3, the connector section 6 is illustrated with the cover member 9 and the check valve 11 removed. The check valve 11 is mounted to a side wall 13 of the connector section 6 from the side as indicated by an arrow A and the cover member 9 is attached to the side wall 13 from the side as indicated by an arrow B so as to be cover the check valve 11 in a manner that the check valve 11 is openable and closable. The connector section 6 is formed on its top with a short tubular projection 12 used for attachment of the mouthpiece section 2. A joining line 19 appears on this tubular projection 12, along which the first and second halves 21, 22 (See FIG. 4) are jointed to each other to form the connector section 6.

Figure 4:
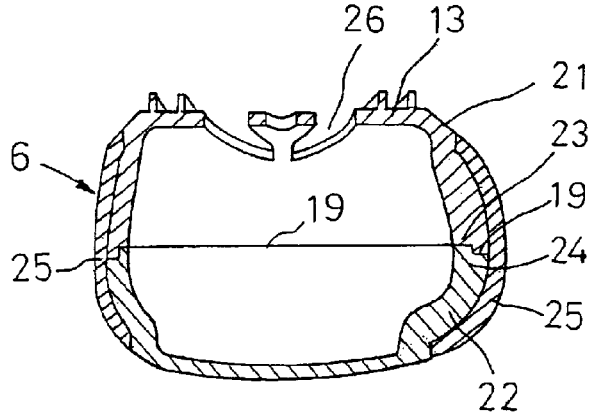
FIG. 4 is a sectional view taken along a line IV—IV in FIG. 2.

FIG. 4 is a sectional view taken along a line IV—IV in FIG. 2, in which the check valve 11 and the cover member 9 are not illustrated. The connector section 6 is hollow and comprises the substantially bowl-shaped first half 21 bulging out upward and the substantially bowl-shaped second half 22 bulging out downward as viewed in FIG. 4. The respective peripheral edges 23, 24 of these first and second halves 21, 22 are opposed to each other and mechanically engaged with or welded or adhesively bonded to each other to define the joining line 19. The first and second halves 21, 22 are partially covered with a belt-like member 25. Specifically, the inner surface of this belt-like member 25 contacts and covers these two halves 21, 22 along the joining line 19 and the respective peripheral edges 23, 24. This belt-like member 25 extends also transversely of the joining line 19 so as to form a substantially C-shaped cross-section and is welded to the outer surfaces of these two halves 21, 22. Such belt-like member 25 defines a region indicated by a plurality of dots in FIGS. 1, 2 and 3. Referring to FIG. 3, the belt-like member 25 extends in a vertical direction.

Figure 5:
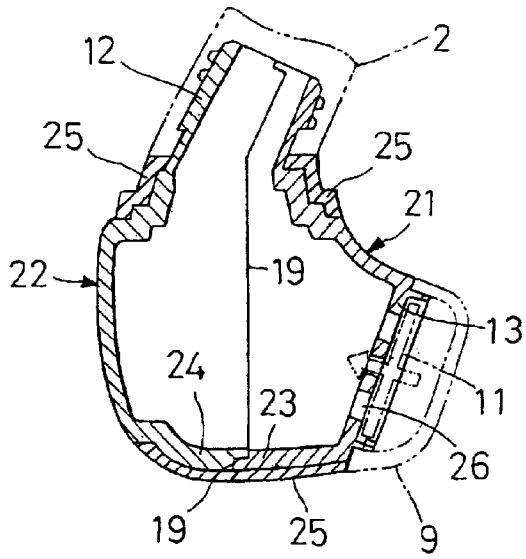
FIG. 5 is a sectional view taken along a line V—V in FIG. 2.

FIG. 5 is a sectional view taken along a line V—V in FIG. 2. The first and second halves 21, 22 are joined to each other along the joining line 19. The first half 21 is formed on its side wall 13 with a window 26 allowing the interior to communicated with the exterior of the connector section 6 and this window 26 is covered from the outside of the side wall 13 with the check valve 11 which is, in turn, protected by the cover member 9. Referring to FIG. 5, the check valve 11 and the cover member 9 are indicated by imaginary lines. The check valve 11 is made of flexible elastic member such as silicon rubber and adapted to bulge outward from the connector section 6 as the swimmer (not shown) exhales. The cover member 9 is made of rigid thermoplastic material such as ABS resin. The belt-like member 25 is welded to the first and second halves 21, 22 defining a bottom of the connector section 6 gently curving so as to extend across the joining line 19 and to present a substantially C-shaped cross-section. In the vicinity of a proximal end of the tubular projection 12 defining a top of the connector section 6, the belt-like member 25 fully extends around this projection 12 across the joining line 19 (See FIGS. 1, 2 and 3). Preferably the belt-like member 25 has its color or color shade different from that of at least one of the first and second halves 21, 22.

The first and second halves 21, 22 of the connector section 6 constructed in this manner may be obtained by injection molding of rigid thermoplastic material such as polycarbonate resin. These halves 21, 22 may be mechanically engaged with each other along respective regions preformed for such engagement or may be pressed against each other along the respective peripheral edges 23, 24 followed by ultrasonic welding or adhesive bonding to integrate these halves 21, 22. Then these halves 21, 22 integrated in this manner may be set within an injection mold and the belt-like member 25 may be formed along the joining line 19 by injection molding. In the connector section 6 obtained in this manner, the first and second halves 21, 22 joined together are held together by the portion of the belt-like member 25 which presents the substantially C-shaped cross-section. A dimension of the belt-like member 25 in the direction extending across the joining line 19 is reduced as the belt-like member 25 contracts in the step of cooling immediately after its injection molding. Consequently, the respective peripheral edges 23, 24 of the first and second halves 21, 22 are further closely joined together and it can be reliably avoided that the connector section 6 might break away or be flooded along the joining line 19. The first and second halves 21, 22 are prevented from breaking away from each other also by the unique arrangement of the belt-like member 25 such that, in the proximal end of the tubular projection 12, the belt-like member 25 fully surrounds this projection 12. In the snorkel 1 according to this invention, as will be apparent from the foregoing description, the belt-like member 25 improves the strength as well as the water-tightness at which the respective peripheral edges 23, 24 of the first and second halves 21, 22 are joined to each other. While the connector section 6 is illustrated to be of the bulb-shape, it is possible without departing the scope of this invention to adopt a tubular connector section 6. In this case, the first and second halves 21, 22 will be halves of a cylindrical tube section each bulging outward of the connector section 6.

The snorkel according to this invention is primarily characterized in that the respective peripheral edges of the first and second halves, for example, in the form of bowl-shaped halves are covered with the belt-like member at least partially extending across the joining line defined by these two halves so as to present the C-shaped cross-section and being welded to these halves. In this way, this invention improves the strength as well as the water-tightness at which the first and second halves are joined to each other.

What is claimed is:

1. A snorkel comprising a mouthpiece section lying under water and adapted to be held in a swimmer's mouth, an open end section, through which both an inspired air and an exhaled air freely flow, a tubular section extending upward in a vertical direction from said open end section, and a hollow connector section interposed between said mouthpiece section and said tubular section and provided with a check valve allowing exhaled air to be exhausted, said snorkel being characterized in that:

said connector section is made of thermoplastic material and comprises first and second halves bulging outwardly of said snorkel, said first and second halves are pressed against each other along respective peripheral edges thereof opposed to each other and covered with a belt-shaped member made of thermoplastic material separately of said first and second halves, wherein said belt-shaped member extends along said peripheral edges and welded to said respective peripheral edges from an outside of said connector section.

2. The snorkel according to claim 1, wherein said first and second halves are respectively bowl-shaped and said connector section consisting of said first and second halves and said belt-shaped member is bulb-shaped.

3. The snorkel according to claim 1, wherein at least a part of said belt-shaped member in its longitudinal direction presents a substantially C-shaped cross-section taken in a direction orthogonal to said peripheral edges of said first and second halves and has its inner surface welded to said peripheral edges.

4. The snorkel according to claim 1, wherein said belt-shaped member has its color or color shade different from that of at least one of said first and second halves.

5. The snorkel according to claim 1, wherein said check valve is mounted on a side wall of said connector section so as to be openable and closable in a transverse direction orthogonal to said vertical direction of said snorkel.

* * * * *